US005120274A

United States Patent [19]

Zeller

[11] Patent Number: 5,120,274

[45] Date of Patent: Jun. 9, 1992

[54] CEILING OUTLET

[75] Inventor: Adalbert Zeller, Kolbingen, Fed. Rep. of Germany

[73] Assignee: Schako Metallwarenfabrik Ferdinand Schad KG, Kolbingen, Fed. Rep. of Germany

[21] Appl. No.: 324,573

[22] Filed: Mar. 16, 1989

[30] Foreign Application Priority Data

Mar. 18, 1988 [DE] Fed. Rep. of Germany ..... 3809157

[51] Int. Cl.[5] ..... F24F 13/06

[52] U.S. Cl. ..... 454/298

[58] Field of Search ..... 98/40.01, 40.1, 40.11, 98/40.18, 41.3

[56] References Cited

U.S. PATENT DOCUMENTS

| | | | |
|---|---|---|---|
| 791,397 | 5/1905 | Asbury | 98/40.01 |
| 1,755,784 | 4/1930 | Jenner . | |
| 2,112,955 | 4/1938 | Downs et al. | 98/40.01 X |
| 2,923,224 | 2/1960 | Stewart | 98/40.11 |
| 2,996,138 | 8/1961 | Schwartz et al. | 98/40.11 X |
| 4,616,559 | 10/1986 | Barlow . | |

FOREIGN PATENT DOCUMENTS

| | | | |
|---|---|---|---|
| 129000 | 12/1984 | European Pat. Off. | 98/41.3 |
| 1802396 | 4/1959 | Fed. Rep. of Germany . | |
| 2043892 | 3/1972 | Fed. Rep. of Germany | 98/41.3 |
| 7924975 | 7/1987 | Fed. Rep. of Germany . | |
| 777366 | 11/1980 | U.S.S.R. | 98/40.11 |
| 1339359 | 9/1987 | U.S.S.R. | 98/40.01 |

*Primary Examiner*—Harold Joyce
*Attorney, Agent, or Firm*—Bachman & LaPointe

[57] ABSTRACT

In a ceiling outlet for three-dimensional airflows into rooms for heating and/or cooling purposes, having a connecting pipe (1) to an appropriate air feed line, a cover plate (3) having apertures (4) is to be positioned in front of the connecting pipe (1) and a rotatable perforated plate (5) is assigned to this cover plate.

6 Claims, 2 Drawing Sheets

CEILING OUTLET

BACKGROUND OF THE INVENTION

The invention relates to a ceiling outlet for three-dimensional airflow into rooms for heating and/or cooling purposes, having a connecting pipe to an appropriate air feed line.

Such ceiling outlets are known in many forms, and it depends on the design of the outlet whether the three-dimensional airflow is produced vertically or horizontally. Moreover, other exemplary embodiments of ceiling outlets possess correspondingly adjustable slats by means of which the three-dimensional flow can be constricted.

The object of the present invention is to provide an economical ceiling outlet which can be used both in high and in low rooms and which permits the three-dimensional airflow to be controlled by simple structural elements.

SUMMARY OF THE INVENTION

This object is achieved in that a cover plate having apertures is positioned in front of the connecting pipe, a rotatable perforated plate being assigned to this cover plate.

As a result of the rotation of the perforated plate in relation to the cover plate, the cross-section of the apertures in the cover plate is influenced so that the three-dimensional airflow can be increased or reduced.

The perforated plate can for example be positioned in front of the cover plate, but it is preferably arranged within the connecting pipe. Moreover, the apertures in the perforated plate will preferably coincide with those in the cover plate, in order thus to achieve a controlled modification of the cross-section of the apertures in the cover plate. In the present exemplary embodiment apertures are round, apertures on one circle about a central point always possessing a uniform diameter, but apertures on the different circular tracks also having different diameters.

The perforated plate possesses an axis of rotation which is preferably at the same time the longitudinal axis of the connecting pipe. Moreover, there is of course assigned to this axis of rotation a corresponding manually actuated or preferably electrical drive by means of which the perforated plate can be rotated.

In one exemplary embodiment of the invention, the connecting pipe can be designed to expand towards the cover plate in the shape of a funnel. Such a shape of ceiling outlet is particularly useful for relatively low rooms, since in this case the airflow is produced more horizontally. In the other exemplary embodiment of the invention the connecting pipe matches the external diameter of the outlet, so that the airflow also emerges vertically into the room through the apertures in the cover plate. This ceiling outlet is particularly suitable for relatively high rooms, since the airflow can penetrate more deeply into the room.

In a further exemplary embodiment of the invention consideration is given to installing a constant three-dimensional flow adjustor in front of the outlet which, irrespective of the resistance, always allows a uniform three-dimensional airflow to pass through. When the cross-section of the apertures in the cover plate is altered, the degree of turbulence is also increased, so that as a result the depths of penetration or projection distances can be substantially shortened. This means that, for a uniform three-dimensional airflow, the depth of penetration into the room can be adjusted without major structural effort.

It is also particularly notable that this ceiling outlet is very pleasing architecturally and differs from the conventional outlet shapes. It would, for example, probably also be usable in a listed building of historic interest.

BRIEF DESCRIPTION OF THE DRAWINGS

Further advantages, features and details of the invention are apparent from the description of preferred exemplary embodiments which follows, and with reference to the drawings in which.

DETAILED DESCRIPTION

Figure 1:
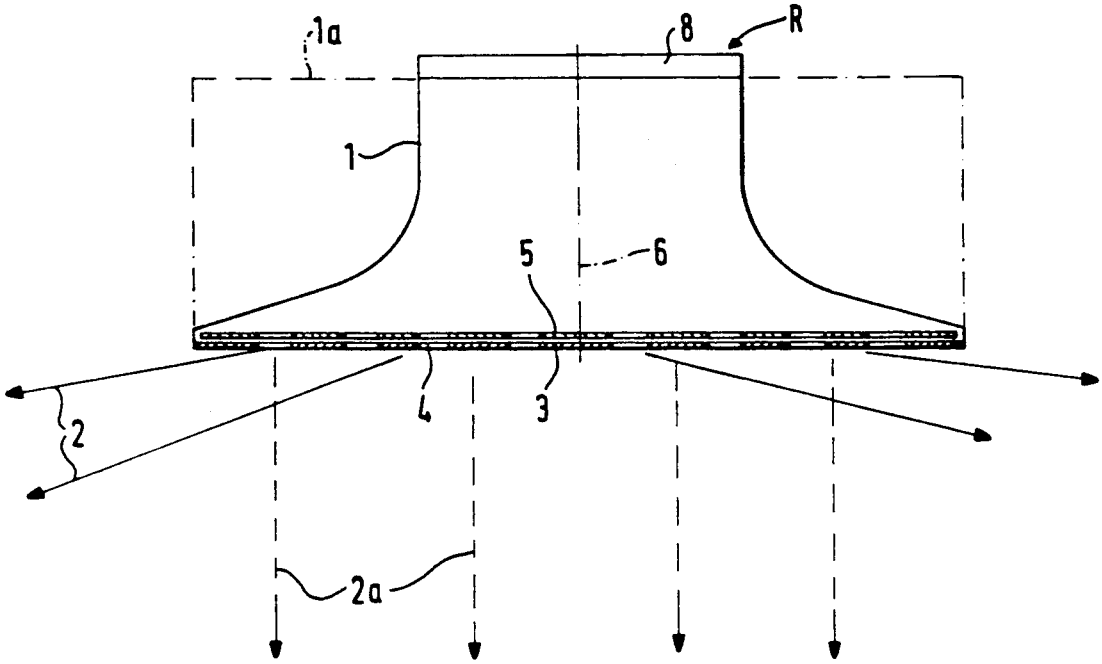
FIG. 1 shows a ceiling outlet represented diagrammatically in cross-section.

According to FIG. 1, a ceiling outlet R comprises a connecting pipe 1 or 1*a*. Two design possibilities are indicated for this in FIG. 1. The round connecting pipe 1*a* shown in broken lines is intended in particular for use in high rooms, since in this case the air introduced is blown out substantially vertically, as is indicated by the arrows 2*a* shown in broken lines.

The connecting pipe 1, by contrast, expands in the manner of a funnel and is therefore used primarily in lower rooms in which the air is blown out more horizontally, which again is indicated by the corresponding arrows 2.

The connecting pipe 1 connects with an appropriate air line, in a manner not shown in more detail. At the room end it is delimited by a cover plate 3 which is perforated by holes 4. These holes 4 have varying diameters in the exemplary embodiment shown.

Within the connecting pipe 1 is a further perforated plate 5, which is positionally assigned to the cover plate 3. This perforated plate 5 is rotatable, and in the present exemplary embodiment this rotation takes place about the axis of rotation 6 shown in dot and dash lines. Suitable drive elements for the rotation of the perforated plate 5 are not shown.

By means of this perforated plate 5, it is possible to intervene in a simple manner in the radiation behavior of the ceiling outlet R. The perforated plate 5 also serves to constrict the three-dimensional flow.

Figure 2:
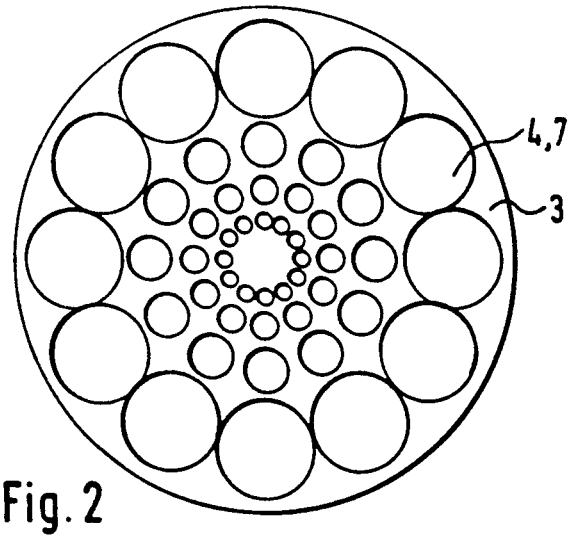
FIG. 2 shows a plan view of the ceiling outlet according to FIG. 1.

According to FIG. 2 the perforated plate 5 and the cover plate 3 are superposed in such a manner that the apertures 4 of the cover plate 3 coincide with apertures 7 of the perforated plate 5. This achieves maximum possible free cross-section of the apertures 4 of the cover plate 3. In this case, also, the maximum possible depths of penetration vertically and the maximum possible projection distances horizontally are possible.

Figure 3:
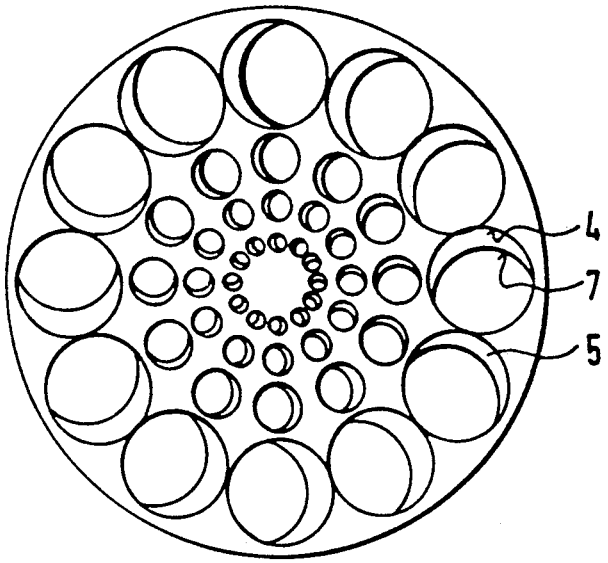
FIG. 3 shows a plan view of the ceiling outlet according to FIG. 1 in a different position of use.
Figure 4:
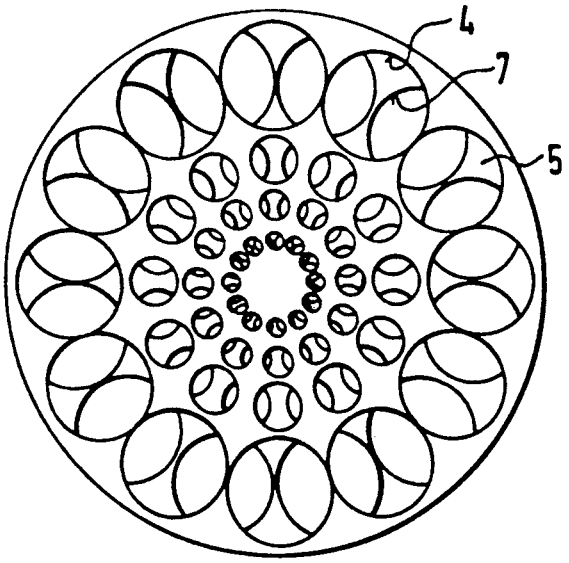
FIG. 4 shows a plan view of the ceiling outlet according to FIG. 1 in a further position of use.

If the perforated plate 5 is now twisted, the configurations shown for example in FIGS. 3 and 4 appear. The result is as follows:

On rotation of the perforated plate 5, the free cross-section of the apertures 4 in the cover plate 3 reduces. As a result the pressure loss also increases, and the three-dimensional flow is reduced. This may be necessary, for example, in order to balance an inlet airflow or if an individual outlet has to be constricted. The latter becomes necessary in the event of draught phenomena.

According to the invention, a constant three-dimensional flow adjustor 8 can furthermore be used in front of the ceiling outlet R. This is intended always to allow the passage of a uniform three-dimensional flow of air, irrespective of the resistance. The result is as follows:

By twisting the perforated plate 5, the degree of turbulence is increased, so that the depths of penetration or projection distances become substantially shorter compared with the initial position shown in FIG. 2. This means that, for a uniform three-dimensional flow, the depth of penetration into the room can be adapted, and this can be done without great effort.

Irrespective of these technical advantages, the appearance of the outlet remains architecturally appealing in all positions of the ceiling outlet R according to the invention so that it can, for example, also be used in listed buildings of historic interest.

I claim:

1. A ceiling outlet for three dimensional air flow into rooms for heating and/or cooling purposes, which comprises:

a connecting pipe connecting to an air feed line and having a longitudinal axis;

a planar cover plate having apertures positioned in front of the connecting pipe;

a rotatable perforated plate positioned within the connecting pipe lying directly on the cover plate so that perforations in the perforated plate coincide with the apertures in the cover plate, the perforated plate having an axis of rotation which corresponds to the longitudinal axis of the connecting pipe and being operative to reduce the area of the apertures and affect the air flow therethrough; and said apertures and said perforations being round and designed with different diameters.

2. A ceiling outlet according to claim 1 wherein the cover plate is fixed and the perforated plate is rotatable with respect thereto.

3. A ceiling outlet according to claim 1 wherein the connecting pipe expands towards the cover plate in the shape of a funnel.

4. A ceiling outlet according to claim 1 wherein the connecting pipe has a round cross section.

5. A ceiling outlet according to claim 1 wherein the cover plate and perforated plate are in the form of flat plates.

6. A ceiling outlet according to claim 1 including flow adjusting means in the connecting pipe upstream of the perforated plate.

* * * * *